US006167854B1

(12) United States Patent
Regueiro

(10) Patent No.: US 6,167,854 B1
(45) Date of Patent: Jan. 2, 2001

(54) TWO-PART VARIABLE VALVE TIMING MECHANISM

(75) Inventor: Jose F. Regueiro, Rochester Hills, MI (US)

(73) Assignee: DaimlerChrysler Corporation, Auburn Hills, MI (US)

( * ) Notice: Under 35 U.S.C. 154(b), the term of this patent shall be extended for 0 days.

(21) Appl. No.: 09/283,019

(22) Filed: Apr. 1, 1999

(51) Int. Cl.[7] ..... F01L 1/344
(52) U.S. Cl. ..... 123/90.17; 123/90.31
(58) Field of Search ..... 123/90.15, 90.17, 123/90.31; 74/568 R

(56) References Cited

U.S. PATENT DOCUMENTS 4,463,712 8/1984 Stojek et al. .
4,561,390 12/1985 Nakamura et al. .
4,976,229 * 12/1990 Charles ..... 123/90.17
4,986,801 1/1991 Ohlendorf et al. .
5,111,780 5/1992 Hannibal .
5,355,849 10/1994 Schiattino .
5,542,383 8/1996 Clarke et al. .
5,673,659 10/1997 Regueiro .
5,680,837 10/1997 Pierik .
5,687,681 11/1997 Hara .
5,803,030 * 9/1998 Cole ..... 123/90.17
5,860,328 * 1/1999 Regueiro ..... 74/568 R

* cited by examiner

*Primary Examiner*—Weilun Lo
(74) *Attorney, Agent, or Firm*—Kenneth H. Maclean

(57) ABSTRACT

A new and improved two-part variable valve timing mechanism which has an axially movable quill shaft extending through a hollow camshaft and has one end of the quill shaft directly connected to the camshaft through straight splines and indirectly connected to helical splines so that axial movement of the quill shaft provided by a ball nut transmission located at the other end of the quill shaft serves to angularly reposition the camshaft a predetermined distance upon actuation of an electric stepper motor.

20 Claims, 4 Drawing Sheets

TWO-PART VARIABLE VALVE TIMING MECHANISM

FIELD OF INVENTION

This invention relates to valve trains of an internal combustion engine and, more particularly, concerns a mechanism for varying the timing of the opening and closing of the intake and exhaust valves with respect to the phase of the piston stroke.

BACKGROUND OF THE INVENTION

During the operation of an internal combustion engine, especially a diesel engine, it is important to have the intake valves close as soon as possible after bottom-dead-center and to retard the opening of the exhaust valve at low speeds to provide a better air cycle. Many types of mechanisms have heretofore been proposed for accomplishing this result and a few examples of such mechanisms can be seen in my U.S. Pat. No. 5,673,659 entitled "Lead Screw Driven Shaft Phase Control Mechanism", issued on Oct. 7, 1997 and assigned to the assignee of this invention.

In general, each of the mechanisms disclosed in the above-mentioned patent provide a selective timing or phase adjusting system between a drive gear and a driven camshaft with the drive gear being coaxially mounted and axially affixed with respect to the driven camshaft for rotation together. An intermediate connecting member is coaxially mounted with respect to the drive gear and the camshaft and is capable of axial movement and angular movement with respect to either the camshaft or the drive gear when experiencing its relative axial movement. The intermediate connection and a coupling member are connected to a geared device that is selectively activated by an electric motor which produces axial movement of both the intermediate connection and the coupling member with respect to the camshaft and the drive gear to any desired axial position between predetermined first and second positions. The gearing device provides a unidirectional drive system which allows the electric control motor to drive the mechanism to provide the optimum shaft phasing and is operably connected to a sleeve that is axially affixed to the intermediate connecting member. When in operation, the gearing device moves the sleeve axially, which in turn, moves the intermediate member axially with respect to both the drive gear and the camshaft. The intermediate connection member is an axially shifting member that has helical splines that rotationally affix it to the camshaft to allow relative rotation of the camshaft with respect to the drive gear. In one embodiment, the gearing device drives the sleeve while in another embodiment the gearing device is a threaded lead screw engaging complementary threads formed on the sleeve. In a third embodiment disclosed in the patent, the gearing device is a part of a gear sprocket that has an internally threaded hub that engages complementary external threads on the sleeve.

SUMMARY OF THE INVENTION

The present invention is functionally similar to the mechanisms described above and seen in my patent but differs in one respect therefrom in that a new form of power transmission is substituted for the threaded jackscrew system which executes the axial motion of the shifting sleeve. Inasmuch as the lowest possible friction level is desired in variable valve timing mechanisms to minimize wear and to allow use of a small electric motor for varying the position of the camshaft, it is important to have a transmission arrangement with less friction than an ACME screw. In this regard, the optimum replacement would be the ball-nut recirculating screw device which enjoys very low friction in operation. However, irrespective of the many advantages provided by such a device, using it for a variable valve timing mechanism according to this invention is not possible from a practical standpoint because the required ball-return duct would interfere with the drive gear. Accordingly, in this instance, I have incorporated into the variable valve timing mechanism made according to the present invention one of the ball-nut transmissions disclosed in my co-pending patent application Daimler-Chrysler File No. 98-1422, entitled "BALL-NUT TRANSMISSION", filed on Mar. 17, 1999, and assigned to the assignee of this invention. Other changes are also part of the present invention and will become more apparent from the detailed description of the new and improved variable valve timing mechanism contained in the specification.

One object of the present invention is to provide a new and improved variable valve timing mechanism that is provided with two major parts one of which is located at the front end of an internal combustion engine and the other is located at the rear end of the engine and in which the control section of the mechanism incorporates a ball-nut transmission for providing linear movement of a quill shaft interacting with straight splines and helical splines for changing the phase of a camshaft.

Another object of the present invention is to provide a new and improved variable valve timing mechanism which has an axially movable quill shaft extending through a hollow camshaft and has one end of the quill shaft directly connected to the camshaft through straight splines and is indirectly connected to helical splines so that axial movement of the quill shaft provided by a ball nut transmission located at the other end of the quill shaft serves to rotate the camshaft a predetermined distance upon actuation of an electric stepper motor.

A further object of the present invention is to provide a new and improved variable valve timing mechanism incorporating a non-recirculating ball-nut transmission for linearly moving a quill shaft and in which balls are incapsulated in hemispherical cavities formed in an axially movable sleeve surrounded by a nut member having a helical groove which cooperates with the balls for providing axial movement of the quill shaft.

The above objects and others are realized in accordance with the invention by a variable valve timing mechanism for an internal combustion engine that in its broadest form comprises a drive timing assembly located at the front end of the engine and a control assembly section located at the rear end of the engine. The timing drive assembly includes a drive gear adapted to be driven by the crankshaft of the engine and a hollow camshaft that extends between the timing drive assembly and the control assembly. A quill shaft is co-axially mounted within the camshaft and has a first portion located at the front end of the engine and is connected to the hollow camshaft by a plurality of straight splines. A hub member is fixed with the drive gear while the first portion of the quill shaft is connected to the hub member by a plurality of helical splines. An axially movable sleeve member is connected to and surrounds a second portion of the quill shaft at the rear end of the engine. In addition, a nut member surrounds the sleeve member and is drivingly connected to the sleeve member through a plurality of circumferentially spaced non-recirculating balls encapsulated between a hemispherical cavity and a helical groove formed in the other of the members so that, upon rotation of the nut member, the sleeve member and the quill shaft move axially relative to the camshaft and, as a result of the helical splines, simultaneously cause the camshaft to rotate relative to the drive gear a predetermined angle so as to provide a change in the opening and closing of the valves of the engine.

BRIEF DESCRIPTION OF THE DRAWINGS

Other objects and advantages of the present invention will be more apparent from the following detailed description of the invention when taken with the drawings in which.

DETAILED DESCRIPTION OF THE INVENTION

Figure 1:
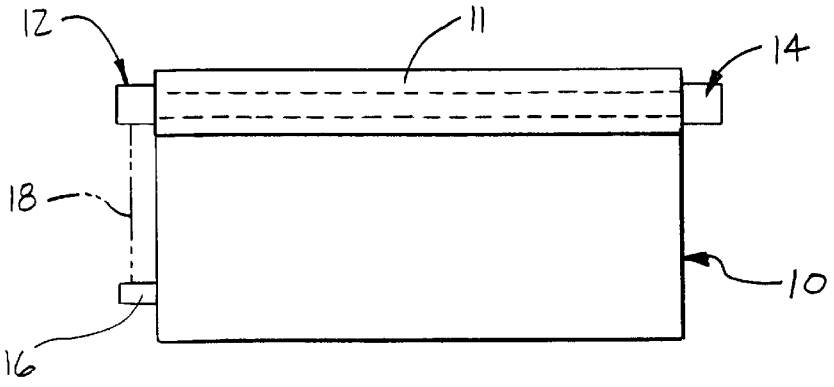
FIG. 1 is a schematic representation of the variable valve timing mechanism according to the present invention combined with an internal combustion engine with the timing drive assembly of the mechanism located at the front end of the engine and connected to the crankshaft of the engine.

Referring to the drawings and more particularly to FIG. 1 thereof, an in-line internal combustion engine 10 is show schematically in block form as being equipped with a split or divided two-part variable valve timing mechanism made in accordance with the present invention. The variable valve timing mechanism shown is intended to be incorporated with the intake camshaft that operates a number of intake valves (not shown) disposed in the cylinder head 11 of the engine 10. It will be understood that a similar variable valve timing mechanism can control the exhaust camshaft of the engine 10.

Figure 2:
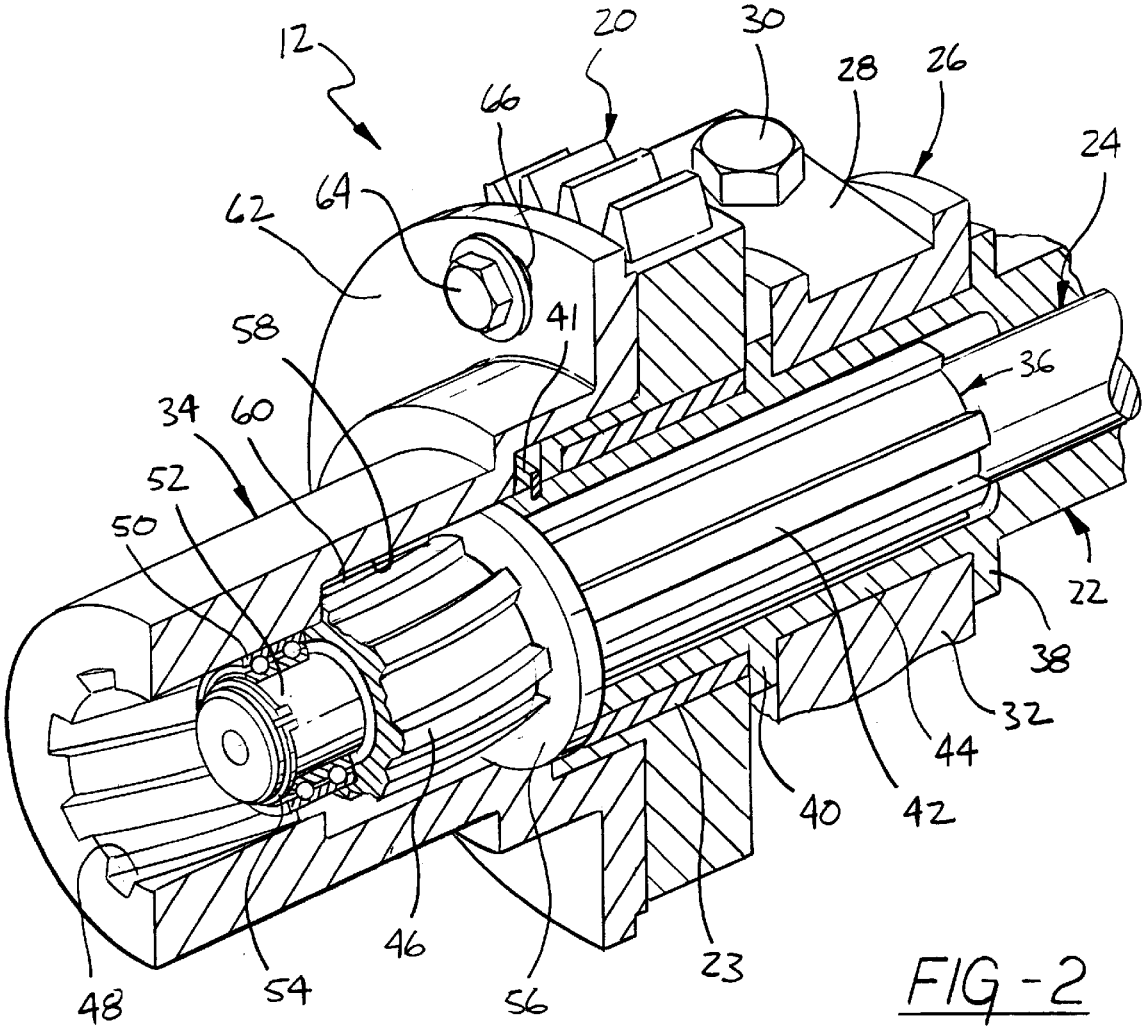
FIG. 2 is an isometric view with parts broken away and some parts in section so as to show the various parts of the timing drive assembly of the variable valve timing mechanism according to the present invention.
Figure 3:
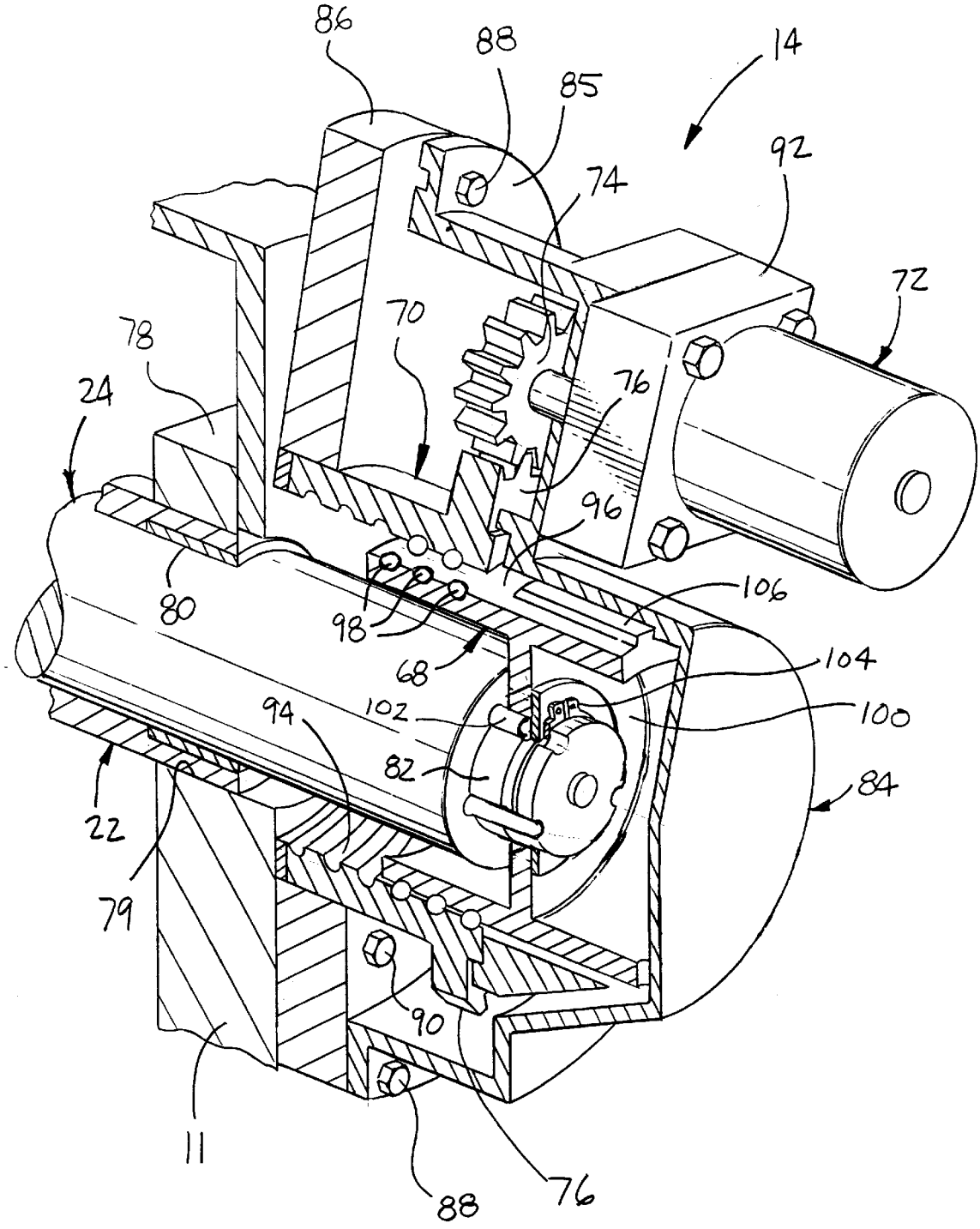
FIG. 3 is an isometric view with parts broken away and some parts sectioned so as to show the various parts of the control assembly that is a part of the variable valve timing mechanism according to the present invention.

The variable valve timing mechanism includes a timing drive assembly 12, as shown in FIG. 2, that is mounted at the front end of the engine 10 and a control assembly 14, as seen in FIG. 3, mounted at the rear of the engine 10. One reason for splitting the timing drive assembly 12 from the control assembly 12 is that in transverse engine installations, there is little space at the front timing-end of the engine, but more space at the rear end of the engine over the transmission.

The crankshaft 16 of the engine is drivingly connected to the timing drive assembly 12 through a gearing arrangement 18 depicted, in this instance, by the dotted lines extending between the timing drive assembly and the crankshaft 16. Alternatively, rather than having a direct gearing arrangement for providing drive to the timing drive assembly 12, a chain drive can be used for this purpose in which case one sprocket would be connected to the crankshaft 16 and another sprocket would be a part of the timing drive assembly 12. In either case, the drive provided to the timing drive assembly 12 would be on 2:1 speed ratio.

As seen in FIG. 2, the timing drive assembly 12 includes a drive gear 20 which is drivingly connected to the front portion of a hollow camshaft 22, the rear portion of which is operatively associated with the control assembly 14 seen in FIG. 3. A bearing sleeve 23 is interposed between the drive gear 20 and the front portion of the camshaft 22. An elongated and cylindrical quill shaft 24 extends through the hollow camshaft 22 and, in effect, interconnects the timing drive assembly 12 with the control assembly 14. As will become more apparent as the description of the invention proceeds, axial movement of the quill shaft 24 relative to the camshaft 22 serves to change the timing or phase relationship between the camshaft 22 and the crankshaft 16.

More specifically and as seen in FIG. 2, the front portion of the timing drive assembly 12 together with the camshaft 22 is supported for rotation by a bearing assembly 26 which includes a semi-cylindrical bearing cap 28 secured by bolts 30 (only one shown) to a bearing saddle 32 integrally formed as part of the cylinder head 11 of the engine 10. In general, the timing drive assembly 12 comprises the drive gear 20, an extended hub member 34, a shiftable shaft 36, and the front portions of the camshaft 22 and the quill shaft 24 all of which are interconnected for rotation about the longitudinal center axis of the camshaft 22. The camshaft 22 is restrained from axial movement by a pair of integrally formed and axially spaced thrust flanges 38 and 40 which abut the opposed sides of the bearing assembly 26 and are annular in configuration. In addition, the drive gear 20 is secured from axial disengagement relative to the camshaft 22 by a thrust bearing-snap ring combination 41 in which the snap ring is located in a groove formed in the front end of the camshaft 22.

The front portion of the quill shaft 24 extends through the shiftable shaft 36, the rear portion of which is connected to the front portion of the camshaft 22 by a plurality of circumferentally and equally spaced straight splines 42 which mate with complementary straight splines 44 formed in the inner cylindrical surface of the front portion of the camshaft 22. The front portion of the shiftable shaft 36 is formed with a plurality of circumferentially and equally spaced helical splines 46 which mate with complementary helical splines 48 formed in the front end of the hub member 34. In addition, the front end of the shiftable shaft 36 is supported by back-to-back thrust bearings 50 mounted on a reduced diameter extension 52 integral with the quill shaft 24. A snap ring 54 secured to the front end of the reduced diameter extension 52 of the quill shaft 24 serves to interconnect the front end (not shown) of the shiftable shaft 36 to the front end of the quill shaft 24 so that axial movement of the quill shaft 24 provides co-joint movement of the shiftable shaft 36 and the quill shaft 24 while allowing the shiftable shaft 36 to rotate relative to the quill shaft 24 as dictated by the helical splines 46 and 48 between the hub member 34 and the shiftable shaft 36. An annular collar 56 is integrally formed with the shiftable shaft 36 between the straight splines 42 and the helical splines 46. The collar 56, located in an enlarged cylindrical cavity 58 formed in the middle portion of the hub member 34, serves to limit axial movement of the shiftable shaft 36 and the quill shaft 24 between the full line position shown in FIG. 2 wherein the collar 56 abuts the front end of the camshaft 22 and a second position (not shown) when the collar 56 abuts an annular shoulder 60 at the entrance point of the helical splines 48 formed in the hub member 34. The rear circular or disk-shaped portion 62 of the hub member 34 is bolted to the drive gear 20 by a plurality of circumferentially spaced bolts one of which is only shown in FIG. 2 and identified by reference numeral 64. Each of the bolts 64 extends through a curved slot 66 formed in the circular portion 62 so as to permit limited angular adjustment of the drive gear 20 relative to the hub member 34 upon loosening of the bolts 64.

Thus, from the above description, it should be apparent that when the drive gear 20 and the hub member 34 are maintained in fixed relative positions and the quill shaft 24 is moved axially forwardly towards the shoulder 60, the shiftable shaft 36 will also move forwardly with the quill shaft 24. As a result, the helical spline connection provided by the helical splines 46 and 48 will cause the shiftable shaft 36 to experience rotation relative to the hub member 34, the drive gear 20, and the quill shaft 24 as dictated by the curvature of the interconnected helical splines 46 and 48. This rotation of the shiftable shaft 36 then causes similar co-joint rotation of the camshaft 22 due to the straight spline interconnection provided by the straight splines 40 and 42 of the camshaft 22 and the shiftable shaft 36, respectively.

In this regard, the control assembly 14 seen in FIG. 3 is positioned at the rear of the engine 10 as aforementioned and as seen in FIG. 1 and provides the above-mentioned axial movement of the quill shaft 24 for a change in timing or phasing of the camshaft 22 relative to the crankshaft 16. The control assembly 14, in general, comprises the rear portion of the quill shaft 24, the rear portion of the camshaft 22, an axially movable sleeve member 68, a nut member 70, and a stepper motor assembly 72. The stepper motor assembly 72 receives input pulses from an electronic control system (not shown) and is adapted to drivingly rotate the nut member 70 through a pair of gears 74 and 76.

In most engines, the timing or phase relationship between a camshaft and a crankshaft is set and is not adjustable during the operation of an engine. However, various engine related operational conditions or parameters, such as speed, load, temperature, or other operative factors, are functional factors that together relate to an ideal timing or phasing of the camshaft relative to the crankshaft. The parameters or factors are sensed by various devices and inputted as signals to an electronic control unit (ECU) which then produces an appropriate desirable output control signal in the form of control pulses that can afterwards be fed to a stepper motor 72 such as in the control assembly 14 for ideal positioning of the camshaft. An ECU for providing such control pulses can be seen in my aforementioned U.S. Pat. No. 5,673,659 and attention is directed to that patent for a full explanation of the manner that the stepper motor of this invention receives the input pulses from an ECU.

As seen in FIG. 3, the rear portion of the camshaft 22 is supported for rotative movement by a bearing cap 78 secured to a bearing saddle 79 integral with the cylinder head 11 of the engine 10. A bushing 80 provides for rotation of the rear portion of the camshaft 22 relative to the quill shaft 24. The rear portion of the quill shaft 24 extends through the hollow camshaft 22 and terminates with a reduced diameter portion 82 located in a housing 84 covering the internal parts of the control assembly 14. The inner flange 85 of the housing 84 is secured to a plate 86 by a plurality of bolts, two of which are only shown in FIG. 3 and each is identified by the reference numeral 88. The plate 86, in turn, is secured to the cylinder head 11 by a plurality of bolts 90 (one of which is only shown). The electric reversible D.C. stepper motor 72 is adapted to operate through a speed reducing gear set (not shown) located within a gear case 92 fastened to the housing 84 and serving to drive the gear 74 upon energization of the stepper motor 72.

As seen in FIG. 3, the gear 74 meshes with the gear 76 which is integral with the nut member 70 that provides axial movement of the sleeve member 68. In this regard, the nut member 70 is cylindrical in cross section and has its inner cylindrical surface formed with a helical groove 94 simulating a screw thread. Similarly, the sleeve member 68 includes a cylindrical section 96 and has a plurality of spherical balls 98 each of which is disposed in an individual hemispherical cavity formed in the outer cylindrical surface of the sleeve member 68. The balls 98 are located along a helical path which matches the helical groove 94 formed in the nut member 70.

The cylindrical section 96 of the sleeve member 68 is integrally formed with a radially inwardly extending flange 100 that is secured to the reduced end of the quill shaft 24 by a plurality of circumferentially spaced keys 102 retained in position by a washer-snap ring combination 104. The outer cylindrical surface of the sleeve member 68 is connected to the housing 84 by a plurality of circumferentially spaced straight spline connections (one of which is only shown and is identified by reference numeral 106) which restrict the sleeve member 68 and the connected quill shaft 24 to axial movement relative to the housing 84 and the camshaft 22.

The variable valve timing mechanism composed of the timing drive assembly 12 and the control assembly 14 seen in FIGS. 2 and 3 and described above operates as follows: When the stepper motor 72 receives an input signal and pulses from the ECU calling for a phase change of the camshaft 22, the gear 74 will be drivingly rotated a predetermined amount and in a direction as dictated by the input signal and pulses. The rotation of the gear 74 will cause corresponding rotation of the nut member 70 through the gear 76. As the nut member 70 rotates about the sleeve member 68, the helical groove 94 acts through the stationary balls 98 to cause the sleeve member 68, together with the quill shaft 24, to move axially relative to the camshaft 22 as controlled by the straight spline connections 106. This axial movement transmitted to the front end of the quill shaft 24, as seen in FIG. 2, will cause the helical splines 46 on the shiftable shaft 36 to move along the complementary helical splines 48 of the hub member 34 resulting in a rotation of the shiftable shaft 36 as explained hereinbefore. The rotation of the shiftable shaft 36 member causes similar rotation of the camshaft 22 through the straight splines 42 and 44 interconnecting the shiftable shaft 36 to the camshaft 22. In this manner, a change in the timing of the camshaft 22 relative to the crankshaft 16 is achieved.

At this juncture, it should be noted that the sleeve member 68 connected to the nut member 70 through the helical groove 94 and the balls 98 constitutes a ball-nut transmission of the type shown in my copending patent application referred to earlier in this specification. Inasmuch as the balls 98 are located in hemispherical cavities and encapsulated between the individual cavity supporting each ball 98 and the groove 94 in the nut member 70, this ball-nut transmission provides an efficient linear movement of the sleeve member 68 with a minimum of friction and without the need for a return duct for the balls as found in the conventional ball-nut-screw devices.

Figure 4:
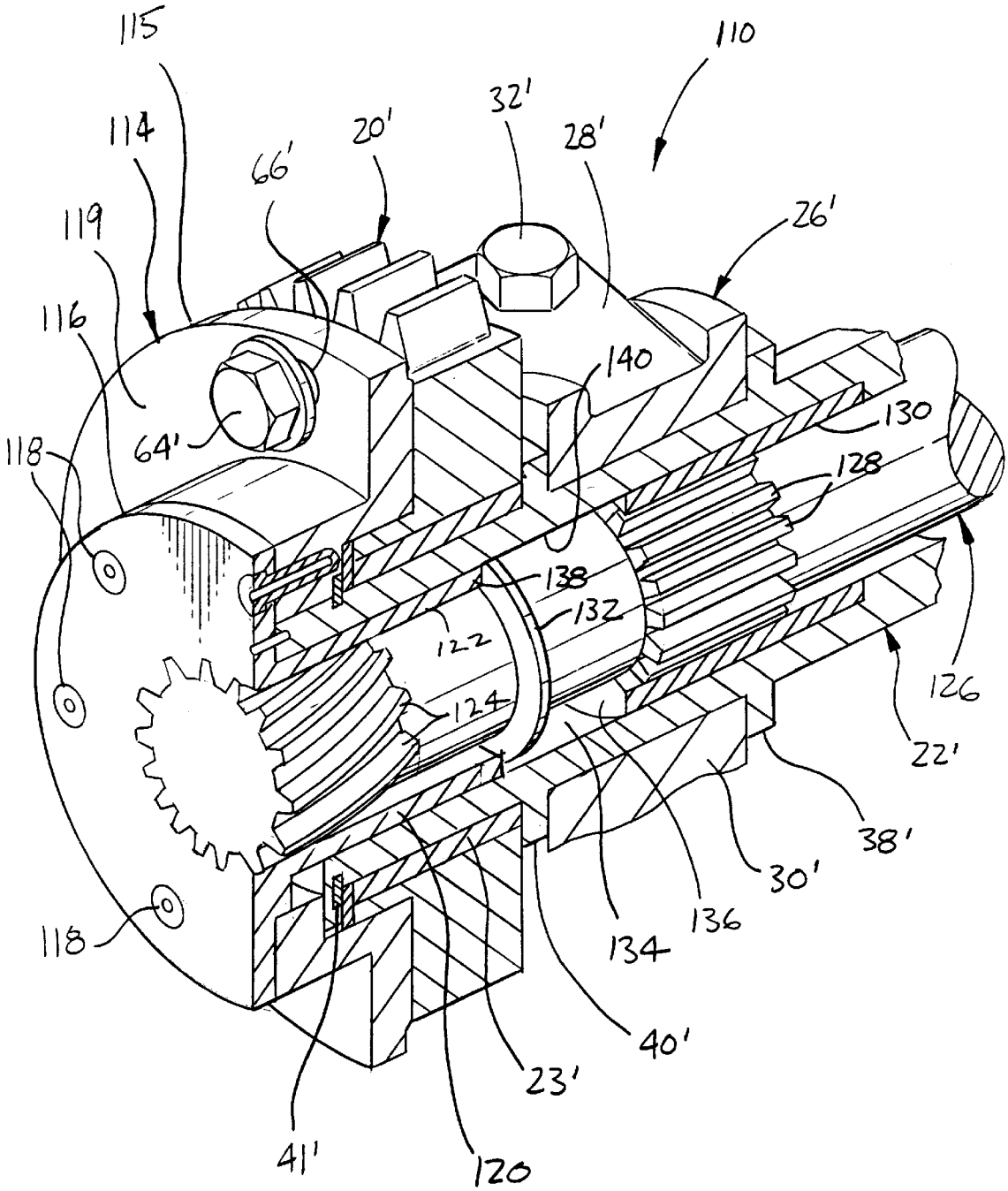
FIG. 4 is an isometric view with parts broken away and some parts sectioned of a modified timing drive assembly according to the present invention.
Figure 5:
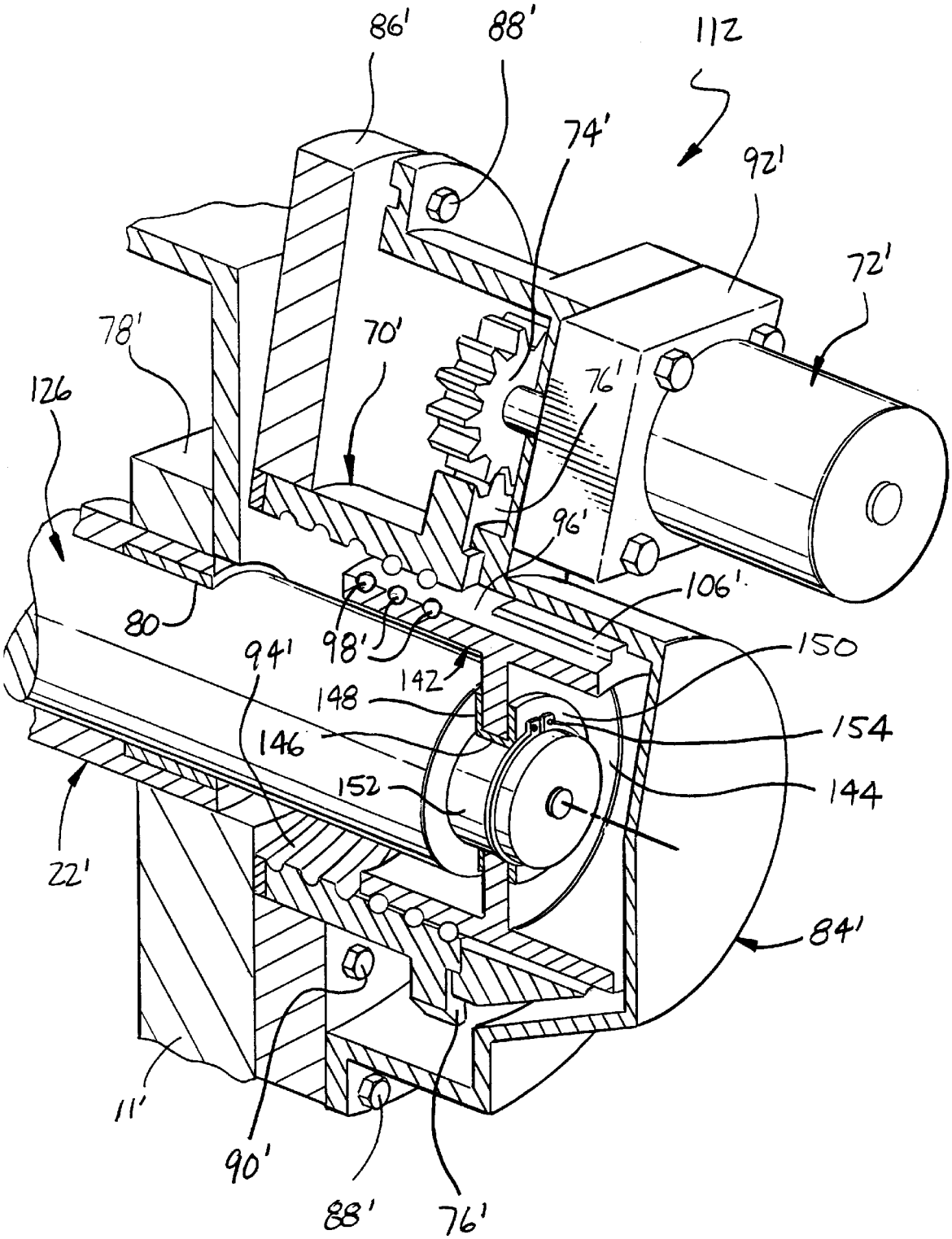
FIG. 5 is an isometric view with parts broken away and some of the parts sectioned of a modified control assembly that is connected to the timing drive assembly of FIG. 4.

FIGS. 4 and 5 show a modified form of a variable valve timing mechanism according to the present invention that consists of a timing drive assembly 110 seen in FIG. 4 that is adapted to be mounted on the front of an internal combustion engine and a control assembly 112, seen in FIG. 4, adapted to be mounted at the rear of the engine. It will be noted that those parts of the variable valve timing mechanism of FIGS. 4 and 5 that correspond to and are identical in construction to the parts of the variable valve timing mechanism of FIGS. 2 and 3 are identified by the same reference numerals but primed.

As in the case of the variable valve timing mechanism of FIGS. 2 and 3, the timing drive assembly 110 includes a drive gear 20' that is adapted to be driven by the crankshaft of the engine in a manner as explained in connection with the variable valve timing mechanism of FIGS. 2 and 3. The drive gear 20' is drivingly connected to a two-part hub member 114 which comprises a hub portion 115 and a cap portion 116 the latter of which is secured to the hub portion 115 by a plurality of circumferentially spaced fasteners 118. As in the case of the timing drive 12 of FIG. 1, a radially extending flange 119 of the hub portion 115 is secured to the drive gear 20' by a plurality of bolts only one of which is shown and indentified by the reference numeral 64' and seen extending through a curved slot 66' formed in the flange 119. The cap portion 116 is integrally formed with a cylindrical extension 120 located within the front portion of the camshaft 22' and has its inner cylindrical surface formed with helical splines 122 which mate with complementary helical splines 124 integrally formed on the front end of a quill shaft 126. Accordingly, rather than having a shiftable shaft connected to the front portion of the quill shaft 126 as a separate rotatable member as in the case of the timing drive assembly 12 of FIG. 2, in this instance, the helical splines 124 are integrally formed with the front portion of the quill shaft 124. Moreover, to the rear of the helical splines 124, a plurality of circumferentially spaced straight splines 128 are integrally formed with the front portion of the quill shaft 126 that serve to interconnect the shiftable shaft portion of the quill shaft 124 with the front portion of a camshaft 22' through the complementary straight splines 130 fixed with the camshaft 22'. Approximately mid-way between the straight splines 128 and the helical splines 124 is an annular collar 132 integral with the quill shaft 126 and located within a cylindrical cavity 134 defined by the end wall 136 of the straight splines 128, the end wall 138 of cylindrical extension 120 of the cap member 116, and the inner cylindrical surface 140 at the front portion of the camshaft 22'. The collar 132 limits the axial movement of the quill shaft 126 between the two end walls 136 and 138, each of which acts as a stop. In this regard, one major difference between the quill shaft 24 in the variable valve timing mechanism of FIGS. 2 and 3 and this quill shaft 126 is that the latter not only moves axially but also rotates bodily as a unit due to the fact that the straight splines 128 and the helical splines 124 are integrally formed with the front portion of the quill shaft 126. Thus, it should be apparent, that when the drive gear 20 is in a fixed position relative to the quill shaft 126 and the latter is caused to move rearwardly axially from the full line position shown in FIG. 3 towards the end wall 136, the helical spline connection between the cylindrical extension 120 of the cap member 116 and quill shaft 126 will cause the latter to experience angular movement which then is transferred to the camshaft 22' through the straight splines 128 to change the angular position of the camshaft 22' relative to the crankshaft of the engine.

The axial movement of the quill shaft 126 is provided by the control assembly 112 mounted at the rear of the engine and shown in FIG. 5. As in the case of the control assembly 14 of FIG. 3, a stepper motor 72', acting through the reduction gearing (not shown) contained in the gear case 92', drives a gear 74' which meshes with a gear 76' integral with a nut member 70'. Upon rotation of the nut member 70', a helical groove 94' formed in its inner cylindrical surface acts through the balls 98' located in hemispherical cavities in the outer cylindrical surface of a sleeve member 96' to cause the sleeve member 142 to move axially relative to the housing 84' of the control assembly 112. As with the sleeve member 68 of the control assembly 14, the sleeve member 142 is restrained from rotative movement by a plurality of circumferentially spaced straight spline connections 106' between the housing 84' and the sleeve member 142. In this instance, a radially inwardly extending flange 144 integral with the inner cylindrical surface of the sleeve member 142 is supported by a sleeve bearing 146 and a pair of axially spaced thrust bearings 148 and 150 located on a reduced diameter portion 152 of the quill shaft 126. The thrust bearings 148 and 150 are held in place by a snap ring 154 located in an annular groove (not shown) formed in the rear end of the quill shaft 126. This arrangement of the sleeve member 142 relative to the quill shaft 126 allows the latter to rotate as dictated by the helical splines 122 and 124 of the timing gear assembly 110. Accordingly, when the stepper motor 72' is activated by the ECU, the gear 74' drives the gear 76' of the nut member 70' causing the latter to rotate and move the sleeve member 142 in an axial direction. As aforementioned, the helical spline connection provided by the helical splines 122 and 124 at the front portion of the quill shaft 126 in the the timing gear assembly 110 causes rotative movement of the quill shaft 126, which movement is transferred to the camshaft 22' through the straight splines 128 and 130 seen in FIG. 4.

Various changes and modifications can be made in the variable valve timing mechanisms described above without departing from the spirit of the invention. Such changes and modifications are contemplated by the inventor and he does not wish to be limited except by the scope of the appended claims.

The embodiments in which an exclusive property or privilege is claimed are defined as follows:

1. A variable valve timing mechanism for an internal combustion engine comprising a timing drive assembly located at one end of said engine and a control assembly located at the other end of said engine, said timing drive assembly having a drive gear adapted to be driven by the crankshaft of said engine, a hollow camshaft extending between said timing drive assembly and said control assembly, a quill shaft co-axially mounted within said hollow camshaft and having a first portion located at said one end of the engine and being connected to said hollow camshaft by a plurality of straight splines surrounding said first portion of said quill shaft, a hub member fixed with said drive gear, said first portion of said quill shaft being connected to said hub member by a plurality of helical splines, an axially movable sleeve member connected to and surrounding a second portion of said quill shaft located at said other end, and a nut member surrounding said sleeve member and being drivingly connected to said sleeve member through a plurality of circumferentially spaced non-recirculating balls encapsulated in one of said members and located in a helical groove formed in the other of said members so that, upon rotation of said nut member, said sleeve member and said quill shaft move axially relative to said camshaft and simultaneously through said helical splines cause said camshaft to change its angular position with respect to said drive gear.

2. The variable valve timing mechanism set forth in claim 1 wherein said first portion of said quill shaft is integrally formed with said straight splines and said helical splines.

3. The variable valve timing mechanism set forth in claim 2 wherein said first and second portions of said quill shaft are supported for rotary movement.

4. The variable valve timing mechanism set forth in claim 1 wherein said first portion of said quill shaft extends through and is rotatable relative to a shiftable shaft which is connected by said straight splines to said camshaft and is connected to said drive gear by said helical splines.

5. The variable valve timing mechanism set forth in claim 4 wherein said second portion of said quill shaft is fixed with said sleeve member so that said quill shaft moves in an axial direction only.

6. A variable valve timing mechanism for an internal combustion engine comprising a timing drive assembly located at one end of said engine and a control assembly located at the other end of said engine, said timing drive assembly having a drive gear adapted to be driven by the crankshaft of said engine, a hollow camshaft extending between said timing drive assembly and said control assembly, a quill shaft coaxially mounted within said camshaft and having a first portion located at said one end of the engine and being connected to said hollow camshaft by a plurality of straight splines integrally formed with said quill shaft and surrounding said first portion of said quill shaft, a hub member fixed with said drive gear, said first portion of said quill shaft being connected to said hub member by a plurality of helical splines integrally formed with said quill shaft, an axially movable sleeve member connected to and surrounding a second portion of said quill shaft located at said other end, a nut member surrounding said sleeve member and being drivingly connected to said sleeve member through a plurality of circumferentially spaced non-recirculating balls encapsulated in one of said members and located in a helical groove formed in the other of said members so that, upon rotation of said nut member, said sleeve member and said quill shaft move axially relative to said camshaft and simultaneously through said helical splines, to cause said camshaft to be angularly repositioned relative to said drive gear, and an electric stepper motor forming a part of said control assembly for rotating said nut member so as to cause the axial movement of said quill shaft and said sleeve member.

7. The variable valve timing mechanism of claim 6 wherein the outer circumference of said nut member is formed with gear teeth which mesh with the gear teeth of a pinion driven by said stepper motor.

8. The variable valve timing mechanism of claim 6 wherein said first portion of said quill shaft is formed with a radially extending collar located between said straight splines and said helical splines for limiting the axial movement of said quill shaft.

9. The variable valve timing mechanism of claim 6 wherein said sleeve member is restrained from rotating about its longitudinal center axis by a plurality of circumferentially spaced straight splines located between said sleeve member and the housing of said control assembly.

10. The variable valve timing mechanism as set forth in claim 6 wherein said drive gear is secured to a hub member supporting a cap member having a cylindrical section formed with internal helical splines which mesh with the helical splines of said quill shaft.

11. The variable valve timing mechanism as set forth in claim 6 wherein said second portion of said quill shaft is supported for limited rotation by a radially inwardly extending flange integrally formed with said sleeve member.

12. The variable valve timing mechanism as set forth in claim 6 wherein said nut member is formed with said helical groove and said sleeve member has a plurality of spherical balls located in hemispherical cavities spaced along a helical path that matches the helical groove in said nut member.

13. A variable valve timing mechanism for an internal combustion engine comprising a timing drive assembly located at one end of said engine and a control assembly located at the other end of said engine, said timing drive assembly having a drive gear adapted to be driven by the crankshaft of said engine, a hollow camshaft extending between said timing drive assembly and said control assembly, a quill shaft coaxially mounted within said hollow camshaft and having a first portion located at said one end of the engine, a shiftable shaft connected to said first portion of said quill shaft for rotatable movement relative to said quill shaft, said shiftable shaft being connected to said hollow camshaft by a plurality of straight splines, a hub member fixed with said drive gear, said shiftable shaft being connected to said hub member by a plurality of helical splines, an axially movable sleeve member connected to and surrounding a second portion of said quill shaft located at said other end, and a nut member surrounding said sleeve member and being drivingly connected to said sleeve member through a plurality of circumferentially spaced non-recirculating balls each of which is encapsulated between a hemispherical cavity formed in one of said members and a helical groove formed in the other of said members so that, upon rotation of said nut member, said sleeve member and said quill shaft move axially relative to said camshaft and simultaneously through said helical splines formed on said shiftable shaft cause said camshaft to be angularly repositioned relative to said drive gear, and an electric stepper motor forming a part of said control assembly for rotating said nut member and causing axial movement of said quill shaft and said sleeve member.

14. The variable valve timing mechanism of claim 13 wherein the outer circumference of said nut member is formed with gear teeth which mesh with the gear teeth of a pinion driven by said stepper motor.

15. The variable valve timing mechanism of claim 13 wherein said first portion of said shiftable shaft is formed with a radially extending collar located between said straight splines and said helical splines for limiting the axial movement of said quill shaft.

16. The variable valve timing mechanism of claim 13 wherein said sleeve member is restrained from rotating about its longitudinal center axis by a plurality of circumferentially spaced straight splines located between said sleeve member and the housing of said control assembly.

17. The variable valve timing mechanism as set forth in claim 13 wherein said drive gear is secured to a hub member having a cylindrical section formed with internal helical splines which mesh with the helical splines of said quill shaft.

18. The variable valve timing mechanism as set forth in claim 13 wherein said second portion of said quill shaft is fixed with a radially inwardly extending flange integrally formed with said sleeve member.

19. The variable valve timing mechanism as set forth in claim 13 wherein said nut member is formed with said helical groove and said sleeve member has a plurality of spherical balls located in hemispherical cavities spaced along a helical path that matches the helical groove in said nut member.

20. The variable valve timing mechanism as set forth in claim 15 wherein said hub member and the end portion of said camshaft cooperate with said collar for limiting the axial movement of said quill shaft.

* * * * *